United States Patent [19]

Cox

[11] Patent Number: 4,973,198

[45] Date of Patent: Nov. 27, 1990

[54] OFFSHORE DRILLING RIG TRANSFER

[75] Inventor: Bobby E. Cox, Kenner, La.

[73] Assignee: Shell Oil Company, Houston, Tex.

[21] Appl. No.: 458,277

[22] Filed: Dec. 28, 1989

[51] Int. Cl.[5] ..... E02B 17/00

[52] U.S. Cl. ..... 405/201; 405/196; 405/195

[58] Field of Search ..... 405/201, 209, 196, 195

[56] References Cited

U.S. PATENT DOCUMENTS

| | | | |
|---|---|---|---|
| H488 | 7/1988 | Rowan | 405/209 |
| 3,477,235 | 11/1969 | Branham et al. . | |
| 4,103,503 | 8/1978 | Smith | 405/201 X |
| 4,655,641 | 4/1987 | Weyler | 405/204 |
| 4,668,127 | 5/1987 | Steele | 405/196 X |
| 4,729,695 | 3/1988 | Silvestri | 405/196 X |
| 4,739,840 | 4/1988 | Cox | 405/195 X |
| 4,753,553 | 6/1988 | Carlsen et al. | 405/195 |
| 4,826,355 | 5/1989 | Marion | 405/209 |
| 4,848,967 | 7/1989 | Weyler | 405/209 X |

*Primary Examiner*—Dennis L. Taylor
*Assistant Examiner*—J. Russell McBee

[57] ABSTRACT

Method and apparatus for transferring a derrick from a jack-up rig to an offshore platform are disclosed which include positioning the rig and platform next to each other, providing an elevator pad on the platform that is set at the same level as the deck of the rig, installing skid beams between the deck of the rig and the top of the elevator pad, skidding the rig from the rig to the pad, and lowering the pad and derrick to the normal level of the platform for use in drilling operations.

16 Claims, 3 Drawing Sheets

30
31
32
33
34
35
36
37
38
40
41
42
43
44
45
46
21
22
17
18
16
13a
13b
10
11
12a
12b
12c
15
14

OFFSHORE DRILLING RIG TRANSFER

This invention relates to a method and apparatus for drilling wells from permanent offshore platforms by moving a derrick from a jack-up type drilling rig onto the permanent platform

BACKGROUND OF THE INVENTION

Offshore structures in the form of large, permanent offshore platforms are erected on the ocean floor to drill wells therefrom to develop oil and gas formations. After the permanent platform has been installed, the necessary drilling equipment including a large drilling derrick is positioned on the platform for drilling a number of wells one at a time. After one well is drilled, the drilling derrick is skidded to a new position and a second or third well is drilled. After the selected number of wells have been drilled from the platform, the drilling equipment including the derrick is removed and placed on barges and towed to another location or to shore. Production equipment is then installed on the platform and the wells are produced after connecting the platform to shore by means of a pipeline.

From time to time it may become desirable to drill an additional well or two from the same permanent platform. However, the drilling equipment and derrick must be reinstalled on the platform to drill these additional wells. A derrick is also necessary to carry out the completions and workovers of deep high pressure wells offshore. However, it is very time consuming to hoist the various equipment, including the derrick, aboard the permanent platform and to assemble the equipment to carry out further drilling or workovers.

The necessary equipment has in the past been shifted off specially rigged jack-up rigs brought alongside the permanent platform. However, only a small fraction of the jack-up rigs allow the continuous load-bearing height adjustments necessary to align the deck levels of the respective platforms. The scarcity of these continuously adjusting jack-up rigs means that such equipment is not always available at the time needed in order to carry out these operations and may remain unavailable for extended periods of time. By contrast, the vast majority of the existing jack-up rig fleet locks off at load-bearing platform levels at increments of five or six feet and are unsuitable at the present time for skidding the drilling equipment to the permanent platform Further, the expense of refitting the jacking mechanisms for these jack-up rigs to provide for continuous height adjustments would require major reworking of substantial components of very expensive offshore vessels. Such major overhauling is economically unattractive in relation to the cost and inconvenience of hoisting unassembled drilling equipment to the permanent platform for assembly there. Thus, there is a substantial need for an apparatus and method to permit use of the existing fleet of jack-up rigs for installing assembled drilling equipment onto permanent platforms.

SUMMARY OF THE INVENTION

The present invention is directed to apparatus and a method of utilizing an offshore jack-up well drilling rig of the type having level adjustments available in increments of several feet or so (hereinafter "jack-up rig") positioned adjacent a permanently positioned offshore production platform, which has been modified so that the drilling derrick at least, and preferably the drilling derrick and the blowout preventer controls normally carried by the jack-up rig can be skidded to the permanent platform. The pumps and other equipment used in drilling operations are left on the jack-up rig with hoses extending between the jack-up rig and the permanent platform so as to provide the necessary fluid or other services to the permanent platform for drilling operations. Since jack-up drilling rigs are limited in their use to water not greater than 300 or 400 feet in depth, the present invention would he limited to the use for permanent platforms at that depth or less.

One example of a cantilevered offshore drilling rig is described in U.S. Pat. No. 3,477,235 to D. R. Branham et al which issued Nov. 11, 1969. In general, this type of a jack-up rig comprises a floatable structure having a pontoon at the upper portion thereof comprising the deck of the structure with the derrick being positioned centrally on the hull or deck of the structure. The jack-up rig is generally provided with three legs which are raised and tower above the vessel when the rig is floated into position in ordinary operation, the legs are jacked down to the ocean floor at the selected site and further jacking of the legs lifts the hull and a deck of the structure, together with the derrick, upwardly on the legs until it is at a suitable operating height, say 50 feet, above the ocean surface. The centrally positioned derrick is then skidded laterally until it is cantilevered over the water off one side of the hull or operating deck. After completing a well, the derrick may be skidded laterally to one side or the other to drill one or more additional wells at selected positions adjacent the first well.

As discussed above, most jack-up rigs in the existing fleet are limited as to the exact height at which the operating deck may be raised in view of the fact that the hoisting mechanism can seat anchoring dogs in the legs only at intervals spaced several feet apart. Since it is the purpose of the present invention to utilize a jack-up rig of this type, there is no certainty that a locked position of the drilling deck of the jack-up rig will be exactly at the same level as the deck of the permanent platform on which operations are to be carried out. More precisely, there is little chance that the rails or beams along which the derrick can be laterally skidded will be aligned at the same vertical height as the skid beams on the top of the permanent platform.

Thus, in order to utilize a jack-up rig of this type, the present invention provides the permanent platform with a removable upper platform section of suitable size which is preferably removably positioned on the top of the permanent platform. This upper platform section must be at least equal to the size, when taken in plan view, of the derrick to be positioned on the permanent platform. Alternatively, the upper platform section may extend over all portions of the top of the platform from which new wells are to be drilled or worked over. The upper platform section added to the top of the permanent platform is provided with a series of power jacks or screws or other suitable hoisting mechanism whereby the upper platform section becomes a leveling unit so that rails carried on the top of the upper platform section may be brought into a horizontal alignment with the longitudinal beams on which the derrick moves on the jack-up rig. The jacks or screws provided on the leveling unit formed by the upper section have a travel at least as great as the distance between the anchoring points or levels on the legs of the jack-up rig. Typically, this will be five to six feet.

In aligning the skid beams of the jack-up rig with those on the top of the upper platform section, the jack-up rig is jacked up and anchored at a level where the longitudinal beams are just above the rails on the top of the upper platform section. The upper platform section is then slowly raised until the rails carried at the top thereof are in horizontal alignment with the longitudinal beams of the jack-up platform so that the derrick thereof can be skidded laterally onto the upper platform section. Subsequently, the upper platform section together with the derrick now mounted thereabove, is lowered by the jacks until the jacks are totally retracted and the upper platform section rests at the tope of the platform on the skid beams below the upper platform section. In this manner, the jacks do not have to support the heavy hook loads which are encountered during normal drilling operations.

BRIEF DESCRIPTION OF THE DRAWINGS

The above brief description as well as further objects, features, and advantages of the present invention will be more fully appreciated by reference to the following detailed description of the presently-preferred, but nonetheless illustrative, embodiment of the present invention with reference to the accompanying drawings in which.

Figure 2:
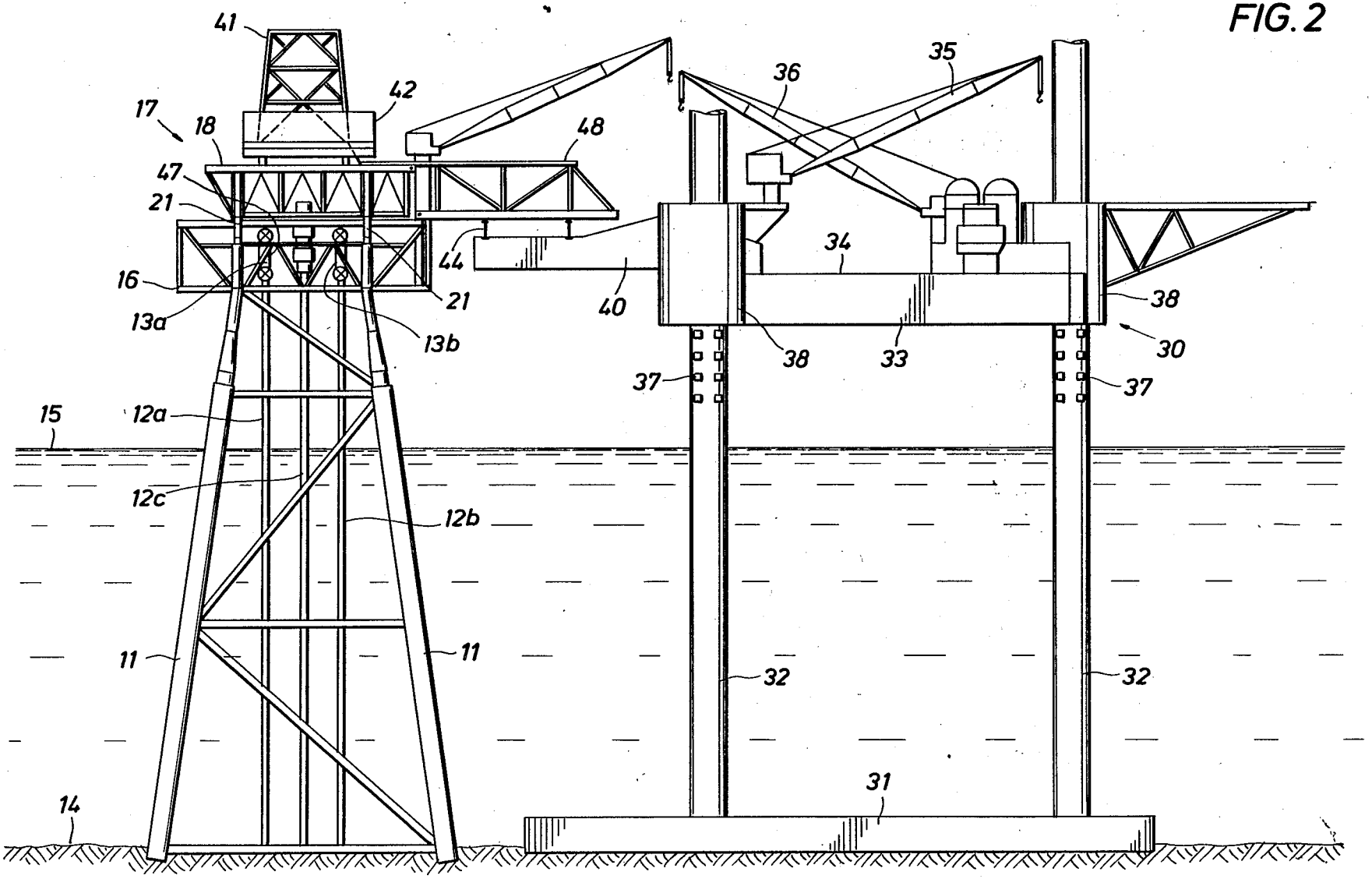
Figure 3:
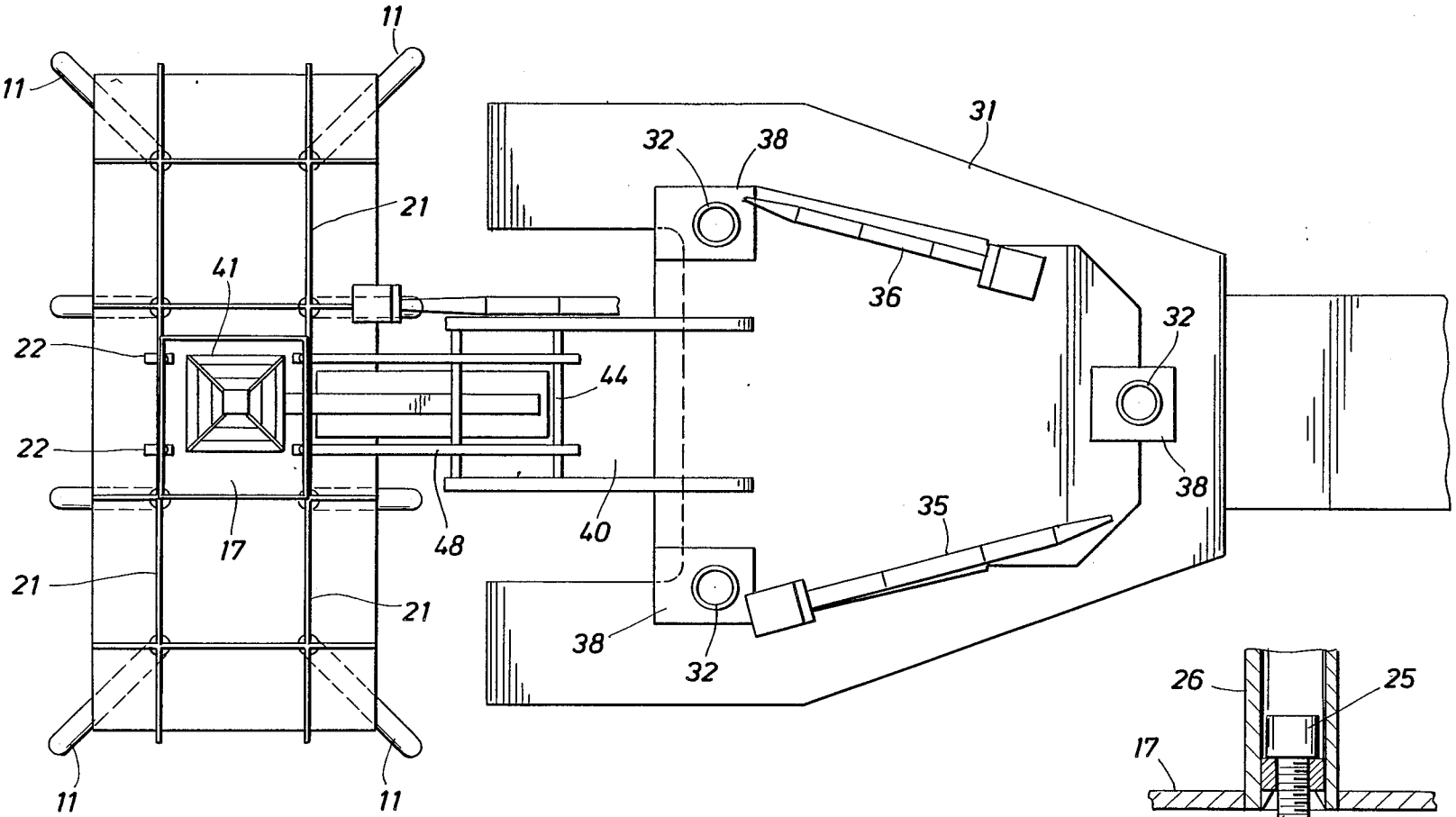

FIG. is a side elevation of the same jack-up rig and permanent platform with the drilling derrick now positioned on the top of the platform;

FIG. 3 is a plan view of the equipment of FIG. 2; and

Figure 4:
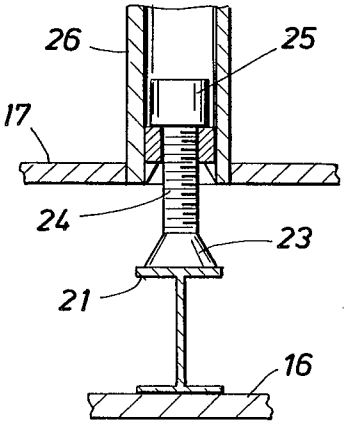

FIG. 4 is a schematic view of one form of a jack which can be employed in the present invention.

DESCRIPTION OF A PREFERRED EMBODIMENT

Figure 1:
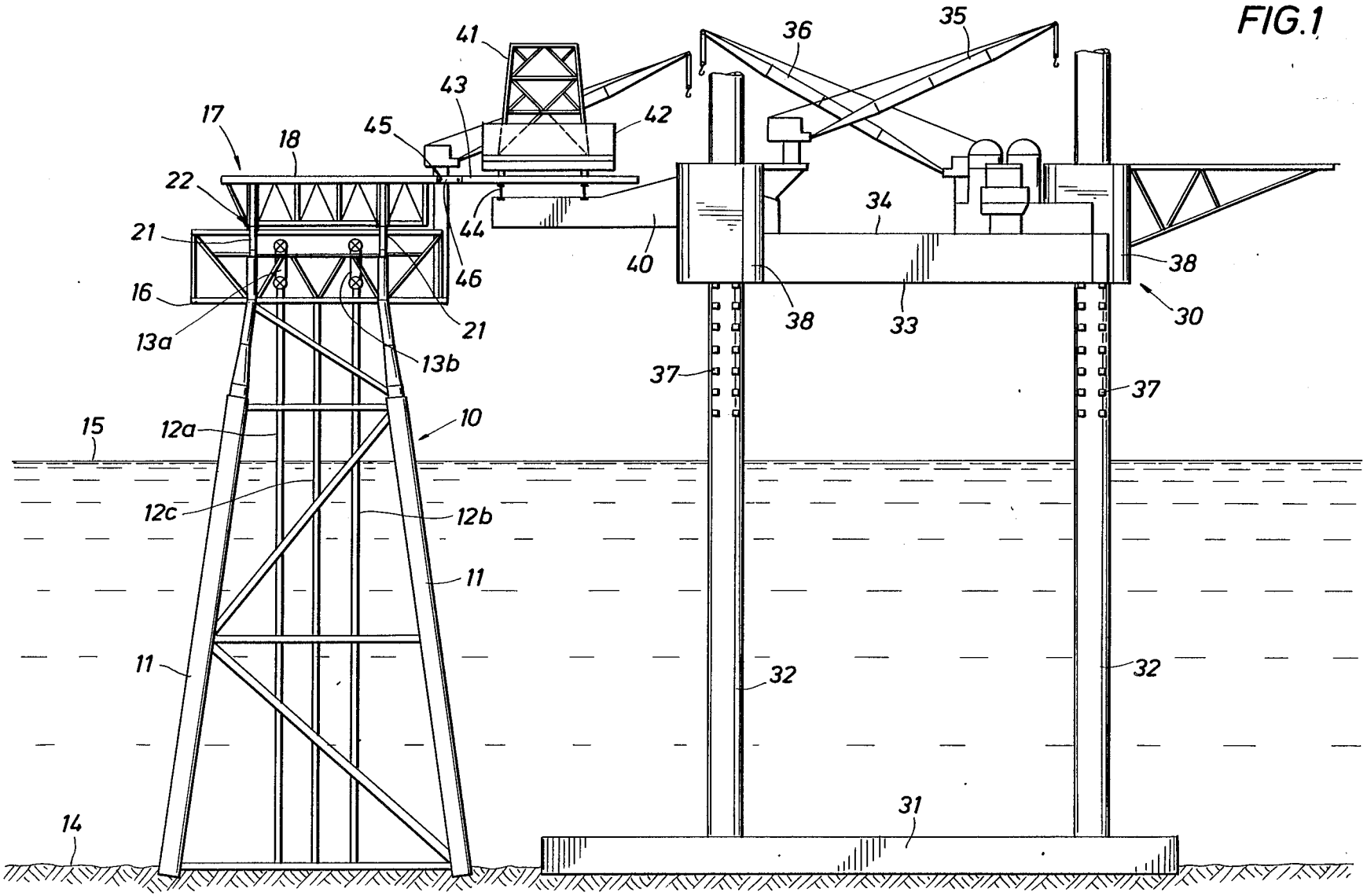
FIG. 1 is a side elevation of a jack-up rig positioned adjacent a permanent platform with a drilling derrick being transferred between the rig and the platform in accordance with the present invention.

Referring to FIG. 1 of the drawings, an offshore production platform is illustrated and referenced generally by the numeral 10. Platform 10 may take any suitable form well known to the art, but is generally provided with a number of legs 11 which are anchored to the ocean floor 14 and extend above the water line 15. A suitable deck 16 is mounted at a selected height above the water surface 15 to hold the various production equipment to be utilized. The platform 10 is shown in FIG. 1 as being provided with three well conductors 12*a*, 12*b* and 12*c*. It is to be assumed that well conductors 12*a* and 12*b* have been used to carry out drilling operations and extend to the underground deposits of oil or gas. These conductors 12*a* and 12*b* have been closed by suitable production wellheads 13*a* and 13*b* in a manner well known to the art.

Since it is desired to utilize conductor 12*c* and drill a well therethrough, the platform 10 is provided with an upper platform section 17 above wellhead and production deck 16 having rails 18 extending laterally across the top thereof.

Upper platform section 17 is installed onto platform 10 prior to moving a drilling derrick 41 thereon. Installation of the upper platform section may proceed in any suitable manner, such as hoisting it into position above platform 10 by means of a derrick barge and then lowering it onto platform skid beams 21 which extend longitudinally across the top of platform 10.

Upper platform section 17 may be constructed of any suitable design, and in the preferred embodiment is a rigid structure formed of a series of truss sections connected together with enough strength to support the derrick on top of the platform. Further, upper platform section 17 may have a height as great as 20 feet or more above the skid beams in order to accommodate components such as blowout preventers and well connectors which will be mounted above conductor pipe 12*c* during drilling operations.

In the preferred embodiment, a series of at least four power or screw jacks 22 are positioned between the top of platform 10 and the bottom of upper platform section 17 which has been placed thereon. Jacks 22 are provided to allow for selectively raising or lowering the upper platform section relative to the top of platform 10 during derrick transfer operations from a jack-up rig. Preferably, the jacks have the capability to adjust the height of upper platform section 17 across a distance of 10 feet or so.

Jacks of any suitable design may be employed and may be either mounted on the top of the platform or carried in a recessed manner in the bottom of upper platform section 17. One suitable type of a screw jack is diagrammatically detailed in FIG. 4. In this arrangement, a footing 23 of jack 22 is in contact with the top of the platform at skid beam 21. The screw jack footing is actuated by a screw section 24 which in turn is driven by a geared motor 25 recessed within a housing 26 formed by a leg of the upper platforms section 17. Screw jack 22 is shown in FIG. 4 in its actuated position, raising upper platform section 17 above skid beams 21. After the derrick is positioned on upper platform section 17 above the top of platforms 10, footing 23 of the screw jack is retracted into housing 26 formed at the bottom of upper platform section 17. Thus, the entire weight of the upper platform section 17 will be distributed directly to skid beams 21 of platform 10.

Returning to FIG. 1, a conventional jack-up rig 30 is shown positioned next to platform 10. A hull unit 33 of the rig is raised to a selected height above water surface 15 in a position supported by ocean floor 14 through a mat 31 and a plurality of legs 32. Suitable equipment for carrying out drilling operations is normally mounted on a deck 34 of the hull of the jack-up rig. Further, such rigs are also typically provided with one or more cranes 35 and 36.

A plurality of elements 37 are illustrated over a short section of the legs of the platform to diagrammatically represent anchoring points adapted to be engaged by jacks 38 of jack-up rig 30 to fixedly secure the hull 33 and deck 34 at a preselected elevation relative to the top of the Platform 10. These anchoring points 37 are generally five or six feet apart.

The jack-up rig 30 is provided with a cantilever rig assembly 40 which is moveably mounted on deck 34 of the jack-up rig. During traveling operations, cantilever rig assembly 40 and derrick 41 carried thereby are retracted from the position illustrated and are generally positioned over deck 34 at a position between legs 32 of the jack-up rig. However, during conventional drilling operations, cantilever rig assembly 40 extends outwardly from deck 34 of the jackup rig 30 so that derrick 41 is positioned over the open water.

Derrick transfer in accordance with the present invention proceeds from an extended cantilever rig assembly 4C upon which the derrick 41 and a derrick module 42 containing related drilling equipment are mounted on a plurality of derrick transfer beams or longitudinal beams 43. The derrick and derrick module may be skidded along longitudinal beams 43 outwardly away from the jack-up rig and onto rails 18 on top of upper platform section 17 of platform 10. The longitudinal beams are in turn positioned on a plurality of lateral transverse beams 44 on which derrick 41 and derrick module 42 on longitudinal beams 43 can be skidded laterally for alignment of longitudinal beams 43 with rails 18 on the top of upper platform section 17.

In transfer operations, cantilever rig assembly 40 of jack-up rig 30 is extended laterally and outwardly to the position illustrated in FIG. 1 with upper platform section 17 resting on the top of the platform skid beams 21. The cantilever rig assembly 40 is jacked up along with hull 33 on legs 32 of the jack-up rig so that longitudinal transfer beams 43 below the derrick 41 are above the skid beams 18 on the top of upper platform section 17. In this position, longitudinal beams 43 would be present at the next higher level above rails 18 on the top of upper platform section 17, which may be between one and six feet above alignment depending upon the vertical spacing of anchor points 37 on legs 32 of the jack-up rig. With longitudinal beams 43 positioned above rails 18, the upper platform section 17 is when raised by power or screw jacks 22 until rails 18 and longitudinal beams 43 are at the same level. The adjacent ends of rails 18 and longitudinal beams 43 are then brought into alignment by skidding derrick 41 and beams 43 laterally in one direction or another on the lateral transverse beams 44. If desired, the outer end of the rails 18 and longitudinal beams 43 may be pinned together in any suitable manner well known to the art, as by means of a pin 45. Alternatively, in the event that the end of longitudinal beam 43 and the adjacent end of the rail 18 do not quite meet, a short beam section 46 could be pinned between the ends of the rail and the longitudinal beam in a weight-supporting manner. The derrick 41 and derrick module 42 would then be moved from the position illustrated in FIG. 1 to the position illustrated in FIG. 2, with the derrick and derrick module resting on top of rails 18 on the top of upper platform section 17. This could be done in any manner well known to the art as by means of winches or by means of a traveling jack system which is well known to the art. With derrick 41 and derrick module 42 now transferred onto the platform 10, screw jacks 22 are actuated to lower upper platform section 17 to rest directly on platform skid beams 21. This is done so that the hook loads experienced during drilling operations of a well through conductor **12*c* will not be imposed upon the jack systems but will be distributed over the top of the platform directly through skid beams 21**.

With derrick 41 and derrick module 42 positioned as illustrated in FIG. 2, a drilling wellhead assembly 47, including blowout preventors, is mounted at the top of conductor pipe **12*c* and drilling operations are carried out. During this time, the deck of jack-up rig 30, together with the cantilever rig assembly 40 thereof, are lowered. This permits a pipe rack module 48 to be positioned on top of the cantilevered section. Thus, generally, only the added drilling derrick 41, derrick module 42, and well-head assembly 47 (including any control equipment used for the blowout preventers) would be supported by the platform 10. In the preferred embodiment, the rest of the drilling equipment such as mud processing equipment, power generation equipment, etc. would remain on jack-up rig 30 with transmission lines extending between the operations on platform 10 and supporting facilities and equipment on jack-up rig 30**.

It may be seen with reference to FIG. 3, that upper platform section 17 together with the derrick 41 mounted thereon may be moved laterally from one end of the platform to the other on platform skid beams 21 and be positioned at any desired location where a well is to be drilled or worked over.

After drilling operations are concluded, derrick 41 and derrick module 42 are returned to the jack-up rig 30 by a reverse of the operations used to transfer it from the rig to the platform 10. Thus, it may be seen that the apparatus of the present invention provides for the addition of upper platform section 17 which in effect is a leveling unit capable of adjusting the level of the permanent platform so as to receive a derrick from a jack-up rig elevated to its next higher incremental level.

Thus, a method has been provided of utilizing an offshore jack-up type well drilling rig and transferring the drilling derrick carried by the rig to a permanently anchored offshore platform for drilling operations such as drilling additional wells or working over an old well.

Further, other modifications, changes, and substitutions are intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A method for transferring an assembled derrick and derrick module to a permanent offshore platform from a jack-up rig of the type having height adjustments available in increments of several feet and deploying a cantilever rig assembly, said method comprising:

mounting the drilling equipment on a plurality of longitudinal beams supported by the jack-up rig on the cantilever rig assembly;

mounting an upper platform section having a plurality of rails presented thereon onto the platform;

moving the jack-up rig into position adjacent the platform;

hoisting the jack-up rig to a height which presents the longitudinal beams of the jack-up rig at the first incremental adjustment available above the height of the rails presented on the platform;

extending the cantilever rig assembly from the jack-up rig toward the platform;

actuating platform jacks to raise the rails of the upper platform section to the level of the longitudinal beams presented by the jack-up rig;

skidding the drilling equipment along the longitudinal beams, off the jack-up rig and onto the rails of the upper platform section; and lowering the upper platform section to secure support directly upon the platform by lowering the platform jacks.

2. A method in accordance with claim 1 further comprising:

laterally aligning the longitudinal beams on the jack-up rig with the rails of the upper platform section by skidding the longitudinal beams over a plurality of lateral transverse beams; and pinning the adjacent ends of the aligned longitudinal beams and the rails together.

3. A method in accordance with claim 2 wherein the platform jacks are mounted between a plurality of skid beams of the platform and the upper platform section and wherein lowering the upper platform section to secure support directly on the platform comprises lowering the platform jacks until the upper platform section rests directly upon the skid beams.

4. A method in accordance with claim 3 further comprising maintaining ancillary drilling support equipment on the jack-up rig in operable communication with the derrick and derrick module now provided on the platform.

5. A method in accordance with claim 4 further comprising mounting a pipe rack on the cantilever rig assembly of the jack-up rig.

6. A method for transferring an assembled derrick and derrick module to a permanent offshore platform from a jack-up rig of the type having height adjustments available in increments of several feet and deploying a cantilever rig assembly, said method comprising:

mounting the drilling equipment on a plurality of longitudinal beams supported by the jack-up rig on the cantilever rig assembly;

mounting an upper platform section having a plurality of rails presented thereon onto the platform upon a plurality of platform jacks which are supported by a plurality of skid beams of the platform;

moving the jack-up rig into position adjacent the platform;

hoisting the jack-up rig to a height which presents the longitudinal beams of the jack-up rig at the first incremental adjustment available above the height of the rails presented on the platform;

extending the cantilever rig assembly from the jack-up rig toward the platform;

actuating the platform jacks to raise the walls of the upper platform section to the level of the longitudinal beams presented by the jack-up rig;

skidding the drilling equipment along the longitudinal beams, off the jack-up rig and onto the rails of the upper platform section;

lowering the upper platform section to secure support directly upon the platform by lowering the platform jacks until the upper platform section rests directly upon the skid beams; and maintaining ancillary drilling support equipment on the jack-up rig in operable communication with the derrick and derrick module now provided on the platform.

7. An apparatus for modifying an offshore platform to allow transfer of a substantially assembled derrick and derrick module from a jack-up rig of the type having incremental height adjustments no closer than several feet apart, the apparatus comprising:

an upper platform section;

a plurality of horizontal rails carried on top of the upper platform section;

a plurality of platform jacks supporting the upper platform section upon the offshore platform, said platform jacks having an adjusting range substantially equal to the spacing between the incremental height adjustments available on the jack-up rig.

8. An apparatus in accordance with claim 7 wherein the platform jack is a screw-type jack.

9. An apparatus in accordance with claim 7 further comprising a housing in the bottom of the upper platform section which receives the platform jack in a recessed manner when the platform jack is withdrawn.

10. A method of utilizing an offshore jack-up type well drilling rig and transferring a drilling derrick therefrom to a permanently anchored offshore production platform, said method comprising:

providing a jack-up type drilling rig having legs lowerable to the ocean floor and a deck assembly together with a cantilever rig assembly forming a lateral extension thereof and adapted to extend outwardly past the legs of said rig, said cantilever rig assembly having a derrick mounted on lateral and transverse skid beams on the upper surface thereof, the height of said deck and cantilever assemblies being selectively movably adjustable up and down the legs and being anchorable at a selected height above the water surface at fixed widely spaced-apart stop locations;

moving the jack-up drilling rig to a position adjacent an offshore production platform anchored to the ocean floor and having lateral skid beams on the top thereof;

providing an upper platform section of a size adapted to fit movably on the platform skid beams on the top deck of said platform, said upper platform section being equipped with spaced-apart skid beams on the top thereof for receiving the derrick from the jack-up rig skid beams;

raising the deck and cantilever sections of the jack-up rig outwardly and anchoring the sections to the legs at the stop location selected so that the lateral skid beams below the derrick are at an elevation above the skid beams on top of the upper platform section;

actuating the platform jacks to raise the upper platform section an amount such that the skid beams on the top of the upper platform section are at the same elevation as that of the lateral skid beams on which the derrick is positioned;

skidding the drilling derrick along the lateral skid beams of the rig and onto the skid beams on top of the upper platform section to the desired location; and lowering the upper platform section by said jacks until said section and the drilling derrick carried thereby are firmly positioned on the top of the derrick.

11. The method of claim 10 including the steps of:

providing a well conductor in said platform with the open upper end of the conductor below said derrick, and carrying out a well-drilling operation within said conductor.

12. The method of claim 10 including the step of moving the derrick and lateral skid beams therefor along the transverse skid beams of the rig until the lateral rig skid beams and those on top of the upper platform section are in substantial alignment.

13. The method of claim 12 including the step of installing short derrick-transfer skid beam sections between the end of the lateral rig skid beams and those on top of the upper platform section to span any substantial space therebetween.

14. The method of claim 11 including the steps of:

lowering the cantilever rig assembly after the derrick has been moved to the platform; and installing a pipe rack module on the lowered cantilevered rig assembly.

15. An apparatus for utilizing a jack-up drilling rig adjacent an offshore production platform and moving the rig derrick to the platform, said platform comprising:

an offshore platform anchored to the ocean floor;

a production deck of said platform containing production wellheads and having skid beams on the top thereof;

a removable upper platform section positioned on top of the production deck of said platform and adapted to be moved laterally on the skid beams thereof;

second skid beams on the top of said removable upper platform section for receiving a derrick thereon; and jack means mounted between the top of said platform and the bottom of said upper platform section for raising and lowering said upper platform section a selected amount.

16. The apparatus of claim 15 wherein the jack means are carried by said upper platform section and are withdrawn within a recess thereof in the inoperative position.

* * * * *